US006567003B2

(12) United States Patent
Kolton et al.

(10) Patent No.: US 6,567,003 B2
(45) Date of Patent: May 20, 2003

(54) ARTICLE IDENTIFICATION AND SECURITY TAG

(75) Inventors: Chester Kolton, Westfield, NJ (US); Michael Norman, East Brunswick, NJ (US); Robert Whittemore, Middletown, NY (US)

(73) Assignee: B&G Plastics, Inc., Newark, NJ (US)

( * ) Notice: Subject to any disclaimer, the term of this patent is extended or adjusted under 35 U.S.C. 154(b) by 38 days.

(21) Appl. No.: 09/954,319

(22) Filed: Sep. 17, 2001

(65) Prior Publication Data

US 2003/0052784 A1 Mar. 20, 2003

(51) Int. Cl.[7] ..... G08B 13/14
(52) U.S. Cl. ..... 340/572.8; 340/572.9
(58) Field of Search ..... 340/572.8, 572.9, 340/572.1, 551, 568.2; 24/305, 326

(56) References Cited

U.S. PATENT DOCUMENTS 5,565,848 A * 10/1996 Leyden et al. ..... 340/568.2
5,717,382 A * 2/1998 Cooper ..... 340/572.8
5,945,909 A 8/1999 Kolton
5,949,336 A * 9/1999 Deschenes et al. ..... 340/572.8
6,128,932 A 10/2000 Mainetti et al.
6,157,302 A 12/2000 Kolton et al.
6,188,320 B1 * 2/2001 Kolton et al. ..... 340/572.9
6,262,664 B1 * 7/2001 Maloney ..... 340/572.8
6,317,046 B1 * 11/2001 Fresnel et al. ..... 340/572.9

* cited by examiner

*Primary Examiner*—John Tweel
(74) *Attorney, Agent, or Firm*—Robin, Blecker & Daley

(57) ABSTRACT

A seal includes a first housing member defining a recess and detent structure and a tail having an end thereof secured with the first housing member and extending outwardly of the first housing member, the tail having a securement structure at a free end thereof, the tail securement structure being receivable in the detent structure, an EAS marker disposed in the recess and a second housing member having a compartment therein for retentively containing the first housing member.

15 Claims, 3 Drawing Sheets

ARTICLE IDENTIFICATION AND SECURITY TAG

FIELD OF THE INVENTION

This invention relates generally to article identification and protection and pertains more particularly to seals having theft-deterrent capability.

BACKGROUND OF THE INVENTION

One type of article identification device having security aspects and having virtual universal applicability to articles is the so-called "seal", such as is shown in U.S. Pat. No. 6,128,932. The seal of the '932 patent comprises a plastic body having a flexible cord (tail) passing through and secured in the body and extending outwardly of the body to a tail free end which has a securement member affixed therewith and of hook configuration providing for irreversible insertion thereof into the body. An elongate electronic article surveillance (EAS) marker or tag is disposed in a compartment defined within the body. The body defines detent structure for effecting retention of the securement member in the body. In addition to the body, the EAS marker and the tail, the seal of the '932 patent has plates bearing logo/article indication applied to the body to close the same.

In use of the seal, the tail is passed through an opening of an article of manufacture, e.g., a watch band of a watch, and the securement member is then inserted into the body. The EAS marker is rendered inactive at checkout of the article of manufacture. Where fraudulent avoidance of checkout (shop-lifting) occurs, the marker is sensed by EAS systems, e.g., at store exits, and suitable alarm is generated.

Other EAS marker containing seals are shown in U.S. Pat. Nos. 5,945,909 and 6,157,302, which are commonly assigned to the assignee of the subject patent application.

Common to all three above-noted patents is that the longitudinal dimension of their seals is dictated by the length of the EAS marker compartment and the length of the detent structure.

In a copending, commonly-assigned patent application, applicants overcome this characteristic of the three-above noted patents by providing the detent structure transversely aside the EAS marker.

In particular, the copending application discloses a seal comprising an elongate body defining therewithin first and second transversely adjacent elongate compartments, a tail having an end thereof secured with the elongate body and extending transversely outwardly of the elongate body and an EAS marker disposed in the first compartment, the tail having a securement structure at a free end thereof the body defining a passage extending from an exterior surface thereof into the second compartment.

The securement structure comprises a member extending orthogonally to the tail and the body passage is sized to receive the securement structure member. The securement structure member preferably includes at least one claw adapted to abut an interior wall of the elongate body bounding the second compartment.

SUMMARY OF THE INVENTION

The present invention has as its primary object to provide improved EAS marker containing seals of lessened longitudinal dimension than the those of the three above-noted patents.

In attaining this and other objects, the invention provides a seal comprising a first housing member defining a recess and detent structure and a tail having an end thereof secured with the first housing member and extending outwardly of the first housing member, the tail having a securement structure at a free end thereof, the tail securement structure being receivable in the detent structure, an EAS marker disposed in the recess and a second housing member having a compartment therein for retentively containing the first housing member.

In a combination aspect, the invention provides an article of manufacture and a seal comprising a first housing member defining a recess and detent structure and a tail having an end thereof secured with the first housing member and extending outwardly of the first housing member and about a portion of the article of manufacture, the tail having a securement structure at a free end thereof, the tail securement structure being disposed in the detent structure, an EAS marker disposed in the recess and a second housing member having a compartment therein for retentively containing the first housing member.

The invention will be further understood from consideration of the following description of preferred embodiments thereof and from the drawings where like reference numerals identify like parts throughout.

DETAILED DESCRIPTION OF PREFERRED EMBODIMENTS AND PRACTICES

Figure 1:
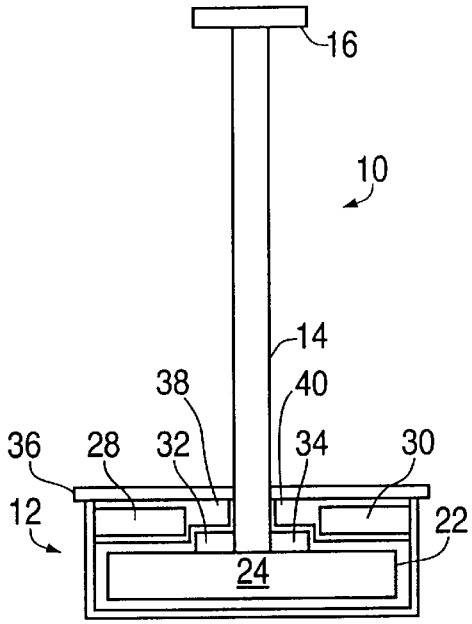
FIG. 1 is a front elevation of a first housing member in accordance with the invention, shown with an EAS member nested therein.
Figure 2:
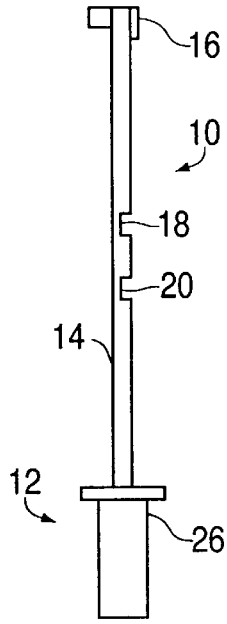
FIG. 2 is right side elevation of FIG. 1.
Figure 3:
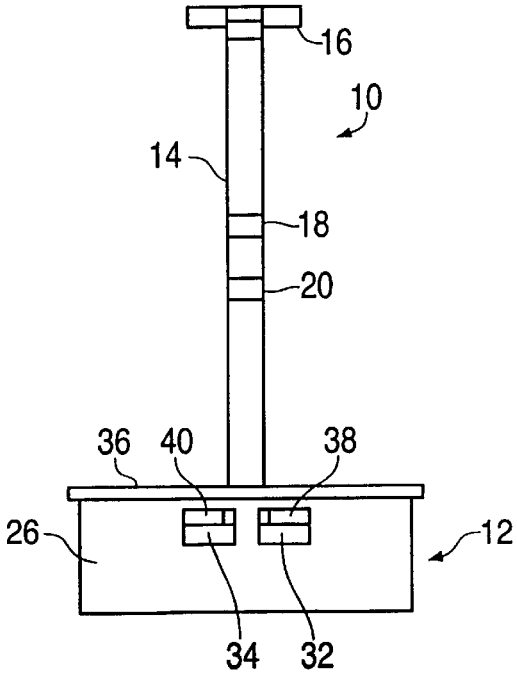
FIG. 3 is a rear elevation of the first housing member.
Figure 4:
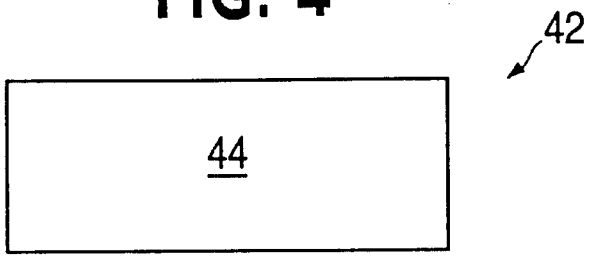
FIG. 4 is a front elevation of a second housing member in accordance with the invention.
Figure 5:
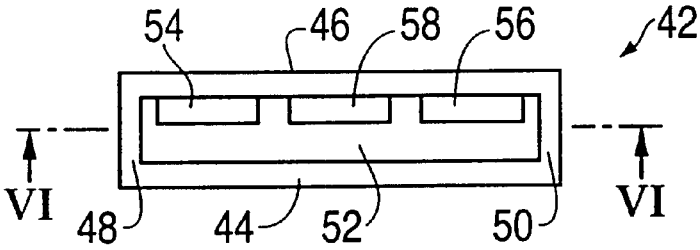
FIG. 5 is a top plan view of FIG. 4.
Figure 6:
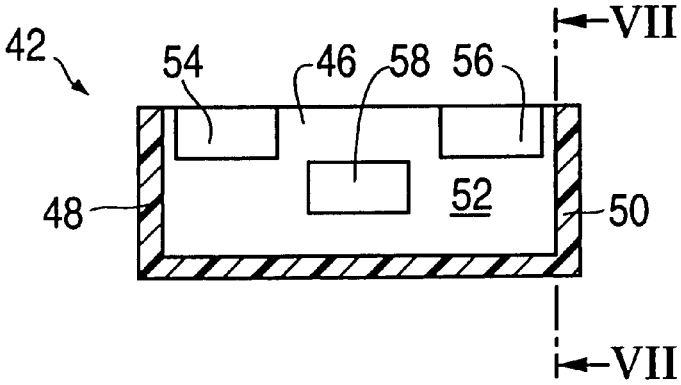
FIG. 6 is sectional view as would be seen from plane VI—VI of FIG. 5.
Figure 7:
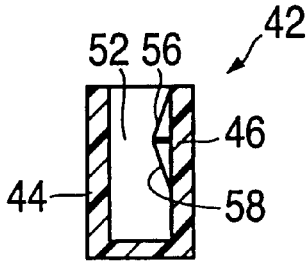
FIG. 7 is a sectional view as would be seen from plane VII—VII of FIG. 6.
Figure 8:
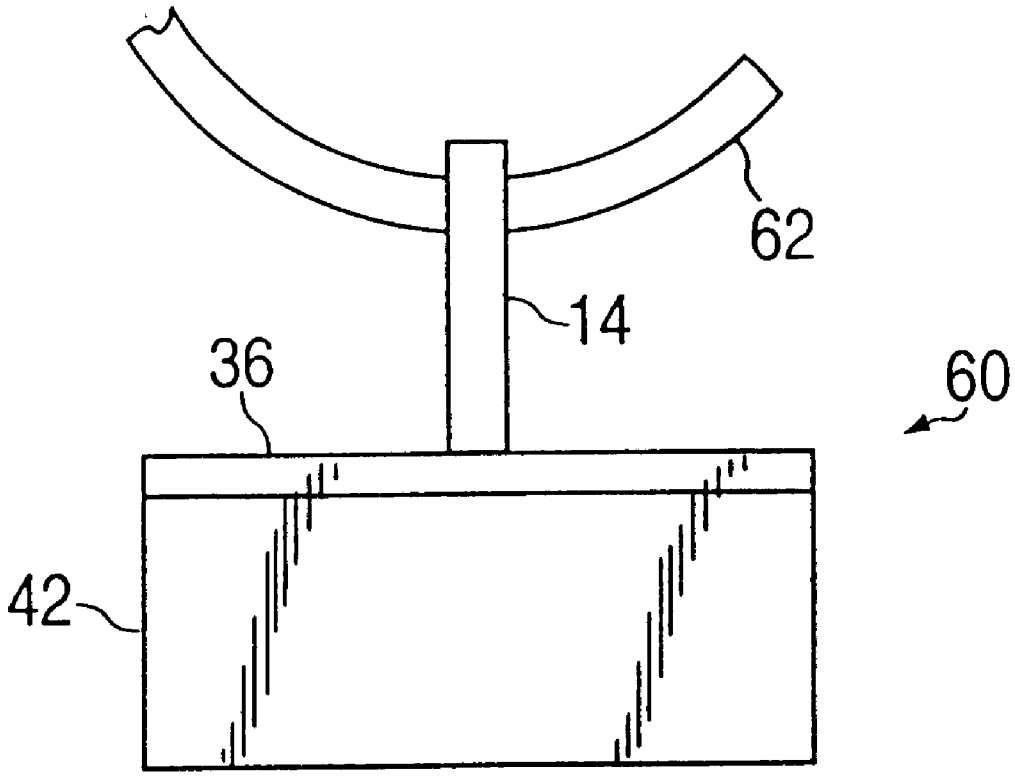
FIG. 8 is a front elevation of a housing assembly of the invention and an article of manufacture secured therewith.

Referring to FIGS. 1–3, first housing member 10 is a one-piece body comprised of molded plastic and includes a lower portion 12 and a tail 14 extending upwardly from lower portion 12 to a securement structure 16 at a tail free end. As is best seen in FIG. 2, tail 14 includes thinned-out sections 18 and 20 to facilitate folding thereof.

Lower portion 12 defines a first recess 22 having EAS member 24 adhesively secured to rear wall 26. Second and third recesses 28 and 30 are located upwardly of first recess 22. Passages 32 and 34 open into rear wall 26.

Closure member 36 extends forwardly and rearwardly outward of first housing member 10. Flanges 38 and 40 extend downwardly from closure member 36 and are spaced forwardly of rear wall 26 and therewith define a nest constituting a detent for retaining tail securement structure 16 in first housing member.

Turning to FIGS. 4–7, second housing member 42 is also a one-piece body comprised of molded plastic and has front wall 44, rear wall 46, sidewall 48 and sidewall 50 bounding open-top compartment 52. Wedge-shaped members 54, 56 and 58 (projections) extend from rear wall 46 into compartment 52. Second and third recesses 28 and 30 function as receptors for wedge-shaped members 54 and 56, when the first and second housings are assembled with one another, as is discussed below.

Compartment 52 is of dimensions permitting entry therein of that part of lower portion 12 which extends downwardly of closure member 36.

In reaching the assembly of seal 60 with article of manufacture 62, shown in FIG. 9, the free end of tail 14 of first housing member 10 is passed through article 62 and is then folded and the tail free end returned to first housing member 10 such that securement structure 16 is in registry with passages 32 and 34. Securement structure 16 is now moved into the passages to register below the nest formed by flanges 38 and 40 and rear wall 26 and is then moved upwardly into the nest.

First housing member 10 is now placed atop compartment 52 of second housing member 42 and is inserted therein. In the course of insertion, wedge-shaped members 54 and 56 enter second and third recesses 28 and 30 (receptors) of lower portion 12 of first housing member 10, securing first housing member 10 in second housing member 42. So assembled, wedge-shaped member 58 confronts the undersurface of securement structure 16. Closure member 36 sits atop the walls of second housing member 42.

By way of summary of the foregoing and introduction to the ensuing claims, the invention will be seen to provide a seal comprising:

(a) a first housing member defining a recess and detent structure and a tail having an end thereof secured with the first housing member and extending outwardly of the first housing member, the tail having a securement structure at a free end thereof, the tail securement structure being receivable in the detent structure;

(b) an EAS marker disposed in the recess; and (c) a second housing member having a compartment therein for retentively containing the first housing member.

The recess and the detent structure extend into an open side of the first housing member, i.e., first housing 10 has a rear wall but not a front wall. The first housing member and the second housing member define respective cooperative retaining means (receptors and wedge-shaped projections) for effecting the retentive containment of the first housing member in the second housing member.

In a combination aspect, the invention provides an assembly of the above-described seal and an article of manufacture secured therewith.

Various changes to the particularly depicted embodiments of the invention may be introduced without departing from the scope of the invention. Accordingly, it is to be appreciated that the particularly disclosed embodiments are intended in an illustrative, and not in a limiting, sense. The true spirit and scope of the invention is set forth in the ensuing claims.

What is claimed is:

1. A seal comprising:

(a) a first housing member defining a recess and detent structure and a tail having an end thereof secured with said first housing member and extending outwardly of said first housing member, said tail having a securement structure at a free end thereof said tail securement structure being receivable in said detent structure;

(b) an EAS marker disposed in said recess; and (c) a second housing member having a compartment therein for retentively containing said first housing member.

2. The seal claimed in claim 1, wherein said recess and said detent structure extend into an open side of said first housing member.

3. The seal claimed in claim 1, wherein said first housing member and said second housing member define respective cooperative retaining means for effecting said retentive containment of said first housing member in said second housing member.

4. The seal claimed in claim 3, wherein said cooperative retaining means comprises at least one receptor in said first housing member and at least one projection on said second housing member disposable in said receptor.

5. The seal claimed in claim 4, wherein said at least one receptor is disposed adjacent said detent structure.

6. The seal claimed in claim 3, wherein said cooperative retaining means comprises first and second receptors in said first housing member and first and second projections on said second housing member.

7. The seal claimed in claim 6, wherein said first and second projections are wedge-shaped in configuration.

8. The seal claimed in claim 4, wherein said first housing member includes a side wall closingly confronting said recess and said at least one receptor.

9. In combination:

(a) an article of manufacture; and (b) a seal comprising:

(1) a first housing member defining a recess and detent structure and a tail having an end thereof secured with said first housing member and extending outwardly of said first housing member and abut a portion of said article of manufacture, said tail having a securement structure at a free end thereof said tail securement structure being disposed in said detent structure;

(2) an EAS marker disposed in said recess; and (3) a second housing member having a compartment therein for retentively containing said first housing member.

10. The invention claimed in claim 9, wherein said recess and said detent structure extend into an open side of said first housing member.

11. The invention claimed in claim 9, wherein said first housing member and said second housing member define respective cooperative retaining means for effecting said retentive containment of said first housing member in said second housing member.

12. The invention claimed in claim 11, wherein said cooperative retaining means comprises at least one receptor in said first housing member and at least one projection on said second housing member disposable in said receptor.

13. The invention claimed in claim 12, wherein said at least one receptor is disposed adjacent said detent structure.

14. The invention claimed in claim 11, wherein said cooperative retaining means comprises first and second receptors in said first housing member and first and second projections on said second housing member.

15. The invention claimed in claim 14, wherein said first and second projections are wedge-shaped in configuration.

* * * * *